United States Patent [19]

Dobashi et al.

[11] Patent Number: 4,871,941

[45] Date of Patent: Oct. 3, 1989

[54] GAS DISCHARGE LAMP WITH DIFFERENT FILM THICKNESSES

[75] Inventors: Yoshitomi Dobashi, Fujisawa; Akihiro Inoue, Chigasaki, both of Japan

[73] Assignee: Kabushiki Kaisha Toshiba, Kawasaki, Japan

[21] Appl. No.: 173,117

[22] Filed: Mar. 25, 1988

[30] Foreign Application Priority Data

Mar. 28, 1987 [JP] Japan ..... 62-74807

[51] Int. Cl.[4] ..... G09G 03/10; H01J 61/06

[52] U.S. Cl. ..... 313/485; 313/488; 313/607

[58] Field of Search ..... 313/45, 635, 488, 485, 313/486, 607; 250/219 AL

[56] References Cited

U.S. PATENT DOCUMENTS

| | | | |
|---|---|---|---|
| 3,716,713 | 2/1973 | Levin | 250/213 VT |
| 3,717,781 | 2/1973 | Sadoski et al. | 313/635 X |
| 4,645,971 | 2/1987 | Ricodeau | 313/527 |
| 4,645,979 | 2/1987 | Chow | 315/169.1 |

FOREIGN PATENT DOCUMENTS

| | | |
|---|---|---|
| 57-38571 | 3/1982 | Japan . |
| 58-34560 | 3/1983 | Japan . |
| 61-95052 | 6/1986 | Japan . |

OTHER PUBLICATIONS

Toshiba Review 1985, 12-1985, vol. 40, No. 12, pp. 1079 to 1082, "Fluorescent Xenon Glow Lamp", Yoshiji Yoshiike.

*Primary Examiner*—Stuart S. Levy
*Assistant Examiner*—Steven M. duBois
*Attorney, Agent, or Firm*—Cushman, Darby & Cushman

[57] ABSTRACT

In a gas discharge lamp of this invention, an internal electrode is provided in a tube bulb and an external electrode is provided on the outer surface of the bulb so as to cover it. A fluorescent material film is formed inside the bulb and is excited to emit visible light by a glow discharge, which is caused by applying a voltage between these electrodes. The fluorescent material film in the bulb has different thicknesses in the tube axial direction of the bulb to average the surface luminance of the gas discharge lamp.

18 Claims, 3 Drawing Sheets

GAS DISCHARGE LAMP WITH DIFFERENT FILM THICKNESSES

U.S. application Ser. No. 07/055,610 filed May 29, 1987 now abandoned, U.S. application Ser. No. 07,127,486 filed Dec. 1, 1987, and U.S. application Ser. No. 073,824 filed Mar. 25, 1988 now abandoned are related to the present application.

BACKGROUND OF THE INVENTION

1. Field of the Invention

The present invention relates to an improvement of a gas discharge lamp, which has an internal electrode provided inside a tube bulb having a fluorescent material film formed on its inner wall and a belt-shaped external electrode provided on the outer surface of the bulb in tight contact therewith in the tube axial direction, and applies a high frequency voltage between the internal and external electrodes to cause a discharge inside the bulb.

2. Description of the Related Art

In the above-mentioned gas discharge lamp, discharge material such as a rare gas or mercury or the mixture thereof is filled in the bulb.

The gas discharge lamp as disclosed in U.S. Pat. No. 4,645,979 is known as the prior art of the gas discharge lamp. According to the disclosed gas discharge lamp, one of the electrodes is provided inside the tube bulb as an internal electrode and the other electrode is formed in a belt shape on the outer surface of the bulb in tight contact therewith, as an external electrode. A high frequency voltage is applied between the internal and external electrodes to cause a glow discharge inside the bulb.

The gas discharge lamp may not have a uniform luminance distribution along the tube axis due to the belt shaped external electrode.

In the gas discharge lamp, there occurs a discharge between the various portions of the external electrode and the internal electrode. Accordingly, the longer the discharge distance between the two electrodes is, the lower the current density in the discharging space is and a smaller amount of fluorescent material is excited.

Near the internal electrodes, however, the electrons emitted from the internal electrode are not sufficiently accelerated, so that the ultraviolet ray generated by the discharge is low and the fluorescent material is not sufficiently excited.

As a result, the luminance is high at the center portion of the bulb and is low at both end portions of the bulb.

Since the external electrode itself has a certain impedance, it is likely that the current density becomes higher at that portion of the external electrode that is close to where a lead wire is extracted and becomes lower at a point farther from the location of the lead wire. This would cause the uneven luminance distribution.

SUMMARY OF THE INVENTION

It is therefore an object of this invention to provide a gas discharge lamp in which the thickness of a fluorescent material film formed on the inner wall of a tube bulb varies in the tube axial direction to thereby make the entire surface luminance of the bulb more uniform as compared with the case where the film thickness is constant.

To achieve the above object, a discharge lamp comprises:

a tube bulb serving as a main body of the discharge lamp;

a fluorescent material film formed on an inner wall of the bulb and excited by an ultraviolet ray, the fluorescent material film having different thicknesses in a tube axial direction so as to average surface luminance over the bulb;

an ultraviolet ray generating medium sealed in the bulb;

an internal electrode provided inside the bulb; and an external electrode formed in a belt shape on an outer surface of the bulb in the tube axial direction.

With the above structure, it is possible to compensate the non-uniform luminance of the bulb. In ordinary gas discharge lamps, the light transmittivity of the fluorescent material film formed on the inner wall of the bulb can be adjusted by changing the film thickness, which however influences the surface luminance of the bulb. It is known that the fluorescent material film with a thickness to have 25~40% of light transmittivity provides the maximum luminance but the film with a thickness to have below 25% or above 40% reduces the luminance. More specifically, with the transmittivity of above 40%, the fluorescent material film cannot sufficiently convert ultraviolet rays into visible light, and with the transmittivity of below 25%, although the fluorescent material film can sufficiently convert the ultraviolet rays into the visible light, the visible light is absorbed by the film and will not come out, thus reducing the light output. According to this invention, therefore, the transmittivity is set to be 25–40% for that portion of the bulb which has a low luminance, thus increasing the luminance there, while it is set to be below 25% or above 40% for that portion of the bulb which has a very high luminance, thus reducing the luminance there.

Adjusting the thickness of the fluorescent material film in the tube axial direction can compensate for non-uniform luminance to thereby provide uniform surface luminance over the bulb.

To light the lamp on, means for applying a high frequency voltage between the internal and external electrodes is provided as an external power source. This power source means causes a glow discharge between the electrodes to emit ultraviolet rays.

BRIEF DESCRIPTION OF THE DRAWINGS

Other object and advantages will be apparent from the following description taken in conjunction with the accompanying drawings in which.

DETAILED DESCRIPTION OF THE PREFERRED EMBODIMENTS

Figure 1:
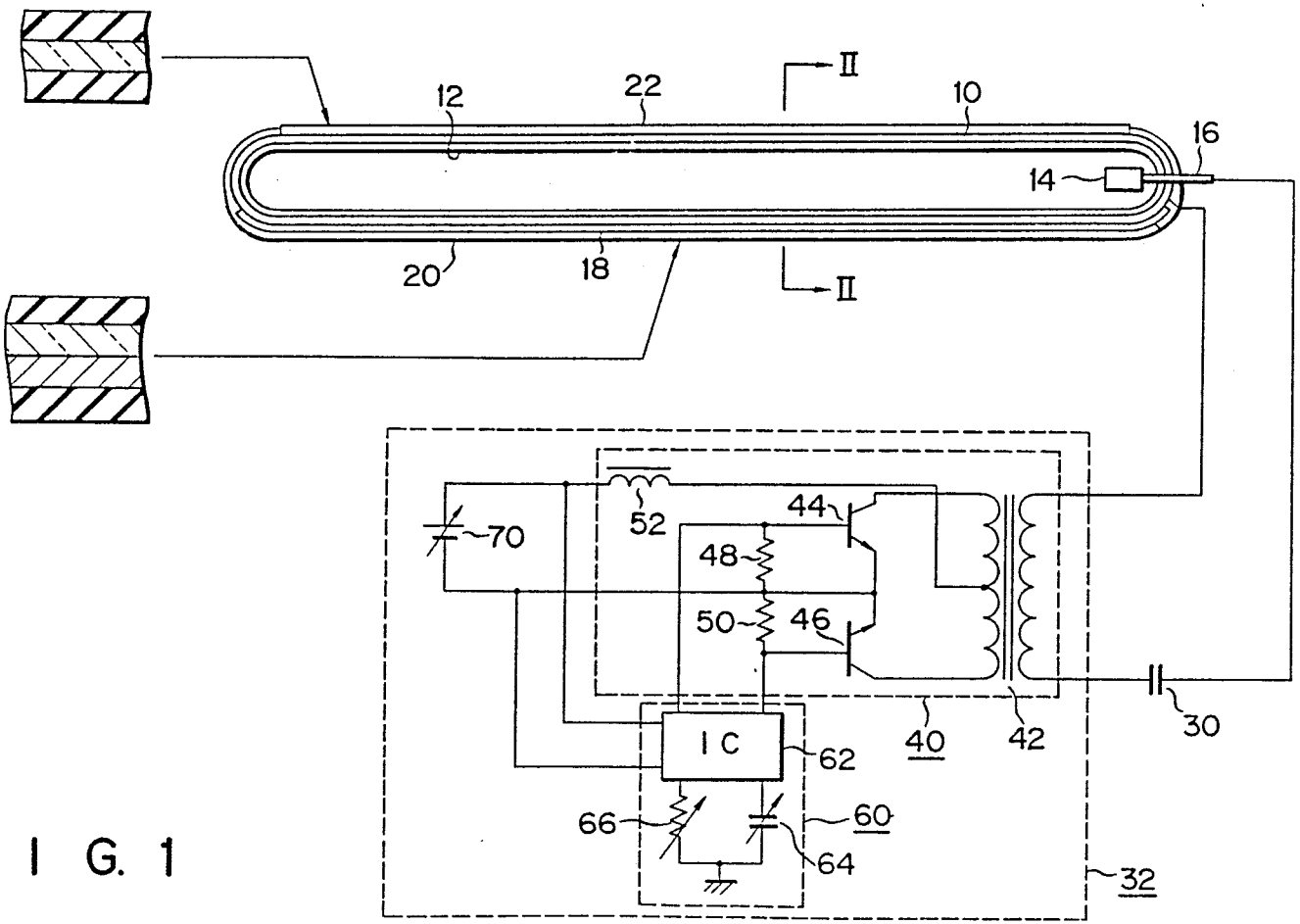
FIG. 1 is a cross-sectional view illustrating the overall structure of a gas discharge lamp including an external power source circuit, according to an embodiment of this invention.
Figure 2:
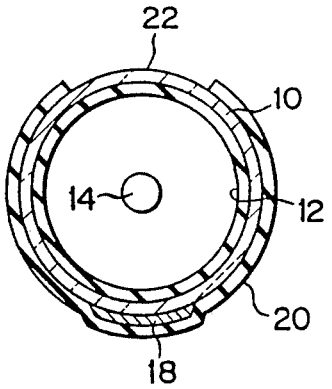
FIG. 2 is a cross-section view taken along line II—II of FIG. 1.
Figure 3:
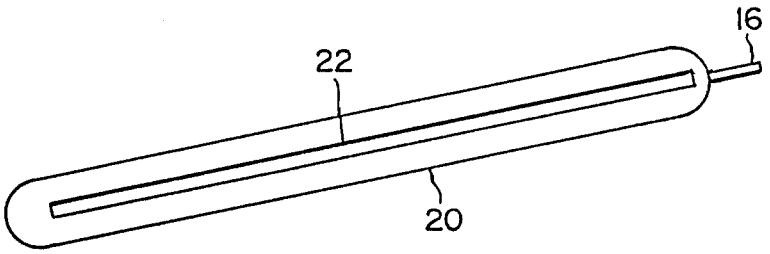
FIG. 3 is a perspective view of the outline of the gas discharge lamp of this invention.

An embodiment of this invention will now be explained with reference to an aperture type rare gas discharge lamp as illustrated in FIGS. 1 through 3.

In FIG. 1, a tube bulb 10 is formed of a thin elongated rod of quartz or hard or soft glass. A fluorescent material film 12 is formed on the inner wall of bulb 10 in which 50 Torr of rare gas that mainly comprises xenon for emitting 147 nm ultraviolet rays to excite the fluorescent material and at least one of krypton, argon, neon, helium or the like, is sealed. Practically, it is desirable that the amount of the rare gas be 20 Torr to 200 Torr. Less than 20 Torr of the rare gas, the intensity of the ultraviolet rays is too weak, and above 200 Torr, this intensity is saturated and the voltage applied to keep the discharge becomes too high to meet the safety standard. The discharge gas in this embodiment is mainly xenon, but mercury may be used instead as discharge gas, thus utilizing the resultant 254 nm ultraviolet rays.

An internal electrode 14 of one polarity is provided in bulb 10 at one end thereof. This electrode 14 is formed of, for example, nickel and is coupled to a lead wire 16, which penetrates in air tight manner through the wall of that end of bulb 10.

An external electrode 18 of the opposite polarity is tightly formed on outer side surface of bulb 10 over the entire length between both ends of bulb 10 and has a belt shape with an approximately uniform width in the tube axial direction. External electrode 18 is made of a conductive coated film which is formed by annealing a coat of paste of copper and carbon.

Further, on the outer surface of bulb 10 is a light shielding film 20, which is formed on the entire outer surface of bulb 10 excluding an opening or slit 22 located opposite to the belt-shape external electrode 18 for light transmission, also covering electrode 18.

Slit 22 of this embodiment has a approximately uniform opening width over its entire length.

Internal electrode 14 and external electrode 18 are coupled to a high frequency power source 32 directly and through a capacitor 30, respectively. High frequency power source 32 comprises an inverter circuit 40, a frequency generator section 60 and a power source 70.

Inverter circuit 40 is a push-pull inverter whose transformer 42 has its primary side coupled to the collectors of switching transistors 44 and 46 and has its secondary side coupled to gas discharge lamp 10. Switching transistors 44 and 46 have their emitters coupled together, with the emitter junction being coupled to the negative terminal (−) of variable D.C. power source 70. Switching transistors 44 and 46 have their bases coupled to an IC 62 (e.g., TL494 of Texas Instrument). IC 62 together with a variable capacitor 64 and a variable resistor 66 constitute frequency generator section 60; the capacitor 64 and the resistor 66 are grounded.

IC 62 is further coupled to the positive and negative terminals of D.C. power source 70 to supply power to IC 62. The positive terminal (+) of D.C. power source 70 is coupled to a predetermined position of the primary side of transformer 42 through a choke coil 52.

In thus constituted rare gas discharge lamp, a high frequency voltage is applied through push-pull inverter 40 to internal electrode 14 and external electrode 18 from D.C power source 70. The frequency of the voltage is properly set by frequency generator section 60, which is constituted by IC 62 variable capacitor 64 and variable resistor 66.

When a high frequency voltage is applied from high frequency power source 32 between internal electrode 14 and external electrode 18, a glow discharge with lamp current of 20 mA or below is caused inside bulb 10. This glow discharge causes resonance rays of the rare gas in bulb 10, for example, mainly 147 nm resonance rays in xenon, to excite fluorescent material film 12 to thereby generate visible light. This visible light is discharged outside of bulb 10. Since light shielding film 20 with slit 22 is formed on the outer surface of bulb 10, the light emitted from fluorescent material film 12 is discharged outside of bulb 10 through the slit 22.

In this lamp, light is discharged only through slit 22, so that the light is given with directivity with respect to its discharging direction and the light is irradiated only toward slit 22.

In the above embodiment, the thickness of fluorescent material film 12 formed on the inner wall of bulb 10 is changed in the tube axial direction.

Figure 4:
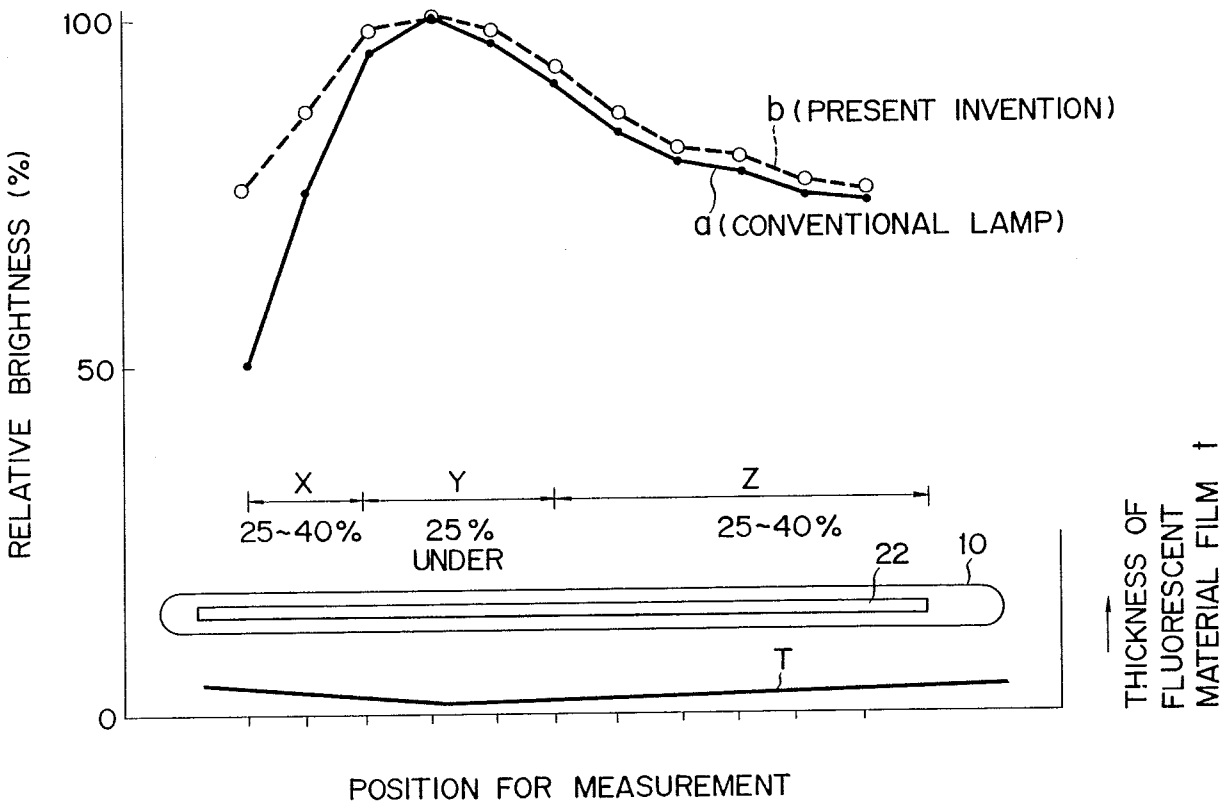
FIG. 4 is a graph illustrating the relationship between a relative brightness and the thickness of a fluorescent material film with respect to the position for measurement, according to the embodiment.
Figure 5:
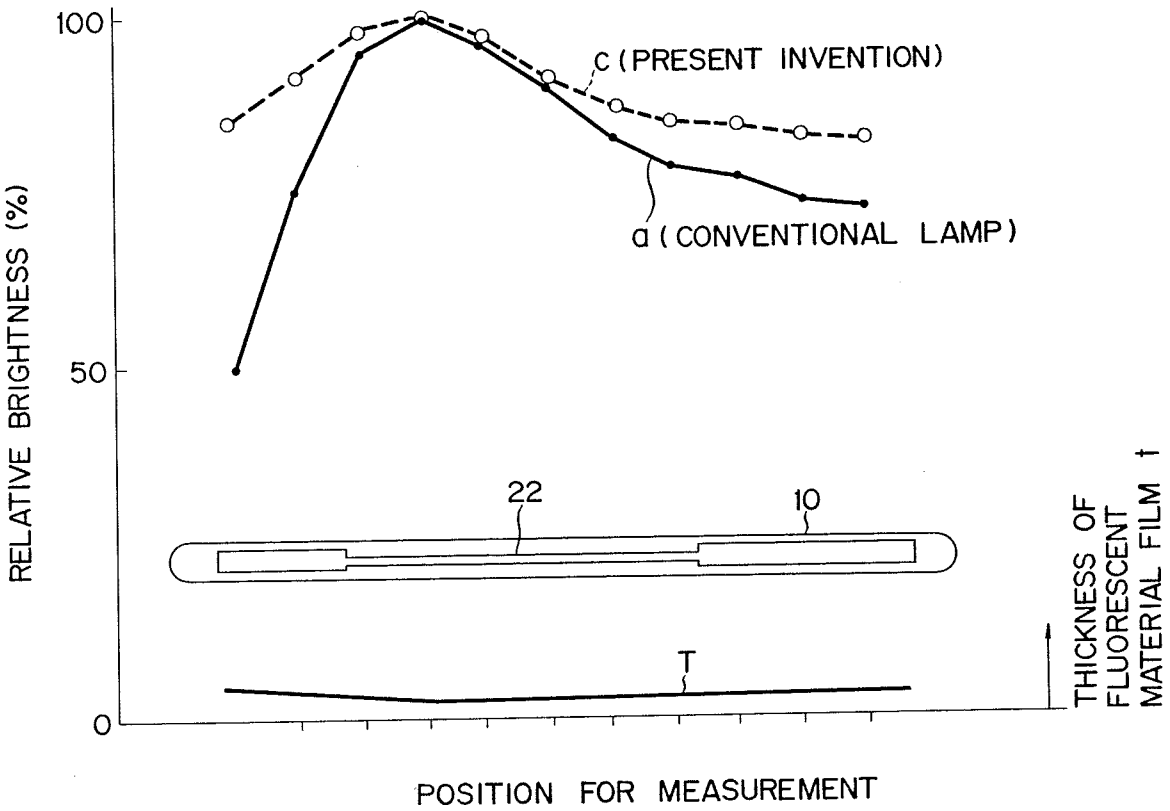

In an aperture type lamp having 50–100 Torr of xenon gas sealed in the bulb with a 2.5 mm outer diameter and a 70 mm length, if fluorescent material film 12 is formed to have a uniform thickness over the entire length, the luminance distribution as indicated by characteristic a in FIG. 4 is produced when the lamp is turned on by a high frequency voltage of 50 KHz. The luminance is high at about the $\frac{2}{3}$ portion of the entire length of bulb 10 from internal electrode 14 and decreases as the sampling points come closer to either end of the bulb.

According to this embodiment, however, the thickness of fluorescent material film 12 is set to have 25–40% of transmittivity in proximal end region X and distal end region Z in FIG. 4 where the film 12 is close to both ends of bulb 10 as well as to be narrower to have more than 40% of transmittivity in region Y in FIG. 4. The change in the film thickness is illustrated as line T in FIG. 4.

With the above arrangement, the luminance distribution over the entire bulb is improved at end regions X and Z and is suppressed at region Y, as shown in curve b in FIG. 4, thus making the relative luminance distribution uniform.

More specifically, while the lamp is ON, discharge is caused between external electrode 18 and internal electrode 14, and although the current density becomes low where external electrode 18 is far from internal electrode 14, the luminance is increased because the thickness of fluorescent material film 12 is set to provide 25–40% transmittivity. Also, since the thickness of fluorescent material film 12 at about $\frac{2}{3}$ portion of the entire bulb length is set to provide more than 40% transmittivity, the luminance at that region is reduced.

As a result, the luminance at regions X and Z at end portions of the bulb is increased while the luminance at region Y is reduced. Therefore, the luminance distribution of bulb 10 is compensated to be more uniform as a whole.

In the rare gas discharge lamp of this embodiment, ultraviolet rays generated by the positive column of the rare gas mainly comprising xenon excite the fluorescent material to discharge the visible light, so that no mercury is used. This is advantageous in that the lamp efficiency will not be influenced by the temperature dependency of mercury, i.e., the dependency of the mercury vapor pressure on the bulb temperature.

This invention is not limited to the above particular embodiment.

For instance, although the thickness of the fluorescent material film is made thinner at region Y to have more than 40% transmittivity in the above embodiment, it may be made thicker to have less than 25% transmittivity so that the amount of the light absorbed is increased to thereby reduce the luminance.

To make the fluorescent material film thinner at the center portion of the bulb and thicker at either end portion thereof, a solution of a fluorescent material needs to be supplied from either end of the bulb to be coated on the bulb's inner wall in such a way as to make the center portion thinner or the drying speed of the fluorescent film needs to be increased by heating at either end of the bulb, thereby forming the heated portions of the film thicker. If the solution of the fluorescent material is supplied from one end of the bulb toward the other end and coated on the bulb's inner wall, the thickness of the fluorescent material film at that region where the excited energy is low needs to be set to have more than 40% transmittivity or less than 25% transmittivity. Particularly, when the inner diameter of the tube is less than 3 mm, it is difficult to finely adjust the thickness of the fluorescent material film in accordance with the excited energy distribution. In such a case, with the film thickness sequentially varied in advance in the direction from one end of the bulb to the other, that portion of the film which produces a low excited energy on the average needs to be set to have 25–40% transmittivity and that portion of the film which produces a high excited energy on the average needs to be set to have less than 25% or more than 40% transmittivity.

Further, since the luminance distribution at that portion of the film where the lead wire is extracted is high, the location of the lead wire may be set at one of the ends of the bulb or at the proximity of that end, the thickness of the fluorescent material film may be sequentially varied in such a way that the film thickness at the lead wire extracting portion is set to have less than 25% or more than 40% transmittivity and the film thickness at the other portion of the film is set to have 25–40% transmittivity.

Two internal electrodes of the same polarity may be tightly mounted at the respective end portions of the bulb.

This invention is not limited to an aperture type rare gas discharge lamp; it may be applied to a gas discharge lamp without light shielding film 20.

Further, as materials to be sealed in bulb 10, mercury may be sealed in the bulb in addition to rare gas comprising at least one of xenon, krypton, argon, neon, helium, or the like so that the ultraviolet rays generated by the mercury and rare gas will excite the fluorescent material or the ultraviolet rays generated only by the mercury will excite the fluorescent material (fluorescent lamp type).

External electrode 18 should not necessarily be formed of copper and carbon, but it may be a metal foil or a transparent conductive film.

There are various means available to make the luminance distribution in the tube axial direction, depending on the averaging direction: averaging toward a higher luminance, toward a lower luminance or toward the middle-level luminance.

What is claimed is:

1. A gas discharge lamp comprising:

a tube bulb;

a gas discharge material filled in said bulb;

an internal electrode provided inside said bulb;

a belt-shaped external electrode formed on an outer surface of said bulb and extending along an axis of said bulb; and a fluorescent material film formed on an inner surface of said bulb; adapted to be excited by a gas discharge, and having a non-uniform thickness along the axis of said tube that varies in accordance with a varying current density to cause a uniform brightness.

2. The discharge lamp according to claim 1, wherein said thickness of said fluorescent material at either end portion of said bulb, which needs luminance to be increased, has transmittivity of 25–40%, and said thickness at a center portion of said bulb, which needs luminance to be decreased, has transmittivity of less than or equal to 25%.

3. The discharge lamp according to claim 1, wherein said fluorescent material film has its thickness sequentially varied.

4. The discharge lamp according to claim 3, wherein said thickness of said fluorescent material film is sequentially varied where a lead wire of said external electrode is extracted and has transmittivity of more than 40%.

5. The discharge lamp according to claim 3, wherein said thickness of said fluorescent material film is sequentially varied where a lead wire of said external electrode is extracted and has transmittivity of less than 25%.

6. The discharge lamp according to claim 1, wherein a light shielding film is formed on an outer surface of said bulb and has a window having a predetermined width for irradiating light outside of said bulb in said tube axial direction of said bulb.

7. The discharge lamp according to claim 1, wherein said external electrode has a width determined such that the lamp has desired operation characteristics.

8. The discharge lamp according to claim 1, wherein said gas discharge material is rare gas.

9. The discharge lamp according to claim 1, further comprising means for applying a high frequency power between said internal electrode and said external electrode to cause a glow discharge between said internal and external electrodes.

10. The discharge lamp according to claim 9, wherein said thickness of said fluorescent material film at neither end portion of said bulb, which needs luminance to be increased, has transmittivity of 25–40%, and said thickness at a center portion of said bulb, which needs luminance to be decreased, has transmittivity of greater than or equal to 40%.

11. The discharge lamp according to claim 9, wherein said thickness of said fluorescent material film at either end portion of said bulb, which needs luminance to be increased, has transmittivity of 25–40%, and said thickness at a center portion of said bulb, which needs luminance to be decreased, has transmittivity of less than or equal to 25%.

12. The discharge lamp according to claim 9, wherein said fluorescent material film has its thickness sequentially varied.

13. The discharge lamp according to claim 12, wherein said thickness of said fluorescent material film has its thickness sequentially varied where a lead wire of said external electrode is extracted and has transmittivity of more than 40%.

14. The discharge lamp according to claim 12, wherein said thickness of said fluorescent material film is sequentially varied in such a way that where a lead wire of said external electrode, is extracted and has transmittivity of less than 25%.

15. The discharge lamp according to claim 9, wherein a light shielding film is formed on an outer surface of said bulb and has a window having a predetermined width for irradiating light outside of said bulb in said tube axial direction of said bulb.

16. The discharge lamp according to claim 9, wherein said external electrode has a width determined such that the lamp has desired operation characteristics.

17. The discharge lamp according to claim 9, wherein said gas discharge material is rare gas.

18. The discharge lamp according to claim 1, wherein said thickness of said fluorescent material film, which needs luminance to be increased, has transmittivity of 25–40%, and said thickness at a center portion of said bulb, which needs luminance to be decreased, has transmittivity of greater than or equal to 40%.

* * * * *